US007699941B2

(12) United States Patent
Pivonka et al.

(10) Patent No.: US 7,699,941 B2
(45) Date of Patent: Apr. 20, 2010

(54) POLYMERIC SURFACE TREATMENT COMPOSITIONS

(75) Inventors: Nicholas Pivonka, Dublin, CA (US); David R. Scheuing, Danville, CA (US); Michael H. Robbins, Marietta, GA (US); Malcolm A. Deleo, Livermore, CA (US)

(73) Assignee: The Clorox Company, Oakland, CA (US)

( * ) Notice: Subject to any disclaimer, the term of this patent is extended or adjusted under 35 U.S.C. 154(b) by 537 days.

(21) Appl. No.: 11/608,134

(22) Filed: Dec. 7, 2006

(65) Prior Publication Data

US 2007/0113353 A1 May 24, 2007

Related U.S. Application Data

(63) Continuation-in-part of application No. 10/263,605, filed on Oct. 2, 2002, now Pat. No. 6,926,745, which is a continuation-in-part of application No. 10/150,363, filed on May 17, 2002, now abandoned.

(51) Int. Cl.
*B05D 1/00* (2006.01)
*C11D 3/37* (2006.01)
*B08B 3/04* (2006.01)

(52) U.S. Cl. ..... 134/42; 134/25.2; 134/39; 510/238; 510/240; 510/475; 510/477

(58) Field of Classification Search ..... 510/238, 510/240, 475, 477; 134/25.2, 39, 42
See application file for complete search history.

(56) References Cited

U.S. PATENT DOCUMENTS

| | | | |
|---|---|---|---|
| 2,798,047 | A | 7/1957 | Touey et al. |
| 4,353,745 | A | 10/1982 | Ebbeler |
| 4,622,075 | A | 11/1986 | Bogner |
| 5,403,883 | A | 4/1995 | Messner et al. |
| 5,409,639 | A | 4/1995 | Fusiak et al. |
| 5,547,612 | A | 8/1996 | Austin et al. |
| 5,693,716 | A | 12/1997 | Bott et al. |
| 6,242,046 | B1 | 6/2001 | Nakane et al. |
| 6,251,849 | B1 | 6/2001 | Jeschke et al. |
| 6,331,517 | B1 | 12/2001 | Durbut |
| 6,433,053 | B1 | 8/2002 | Kasturi et al. |
| 2003/0017960 | A1 | 1/2003 | Bertrem et al. |
| 2003/0045439 | A1 | 3/2003 | Evers |

FOREIGN PATENT DOCUMENTS

| | | | |
|---|---|---|---|
| EP | 0 467 472 | A2 | 1/1992 |
| EP | 0 859 046 | B1 | 8/1998 |
| EP | 1 362 907 | | 11/2003 |
| EP | 1362907 | A2 * | 11/2003 |
| WO | WO 96/00251 | | 4/1996 |
| WO | WO 00/29538 | | 5/2000 |
| WO | WO 00/77143 | | 12/2000 |
| WO | WO 01/05920 | | 1/2001 |
| WO | WO 02/18531 | | 3/2002 |

* cited by examiner

*Primary Examiner*—Brian P Mruk
(74) *Attorney, Agent, or Firm*—Erin Collins

(57) ABSTRACT

Treated articles with improved water sheeting and soap scum repellency result from forming hydroscopic films on the surfaces of hydrophobic polymeric substrates treated with compositions, kits and methods that employ water-soluble or water-dispersible copolymers having: (i) a first monomer that is capable of forming a cationic charge on protonation; (ii) a second monomer that is acidic and that is capable of forming an anionic charge in the compositions; (iii) optionally, a third monomer having an uncharged hydrophilic group; and (iv) optionally, a fourth monomer that is hydrophobic. Treated articles exhibit a Water Sheeting Index of greater than 6. Treated articles may further exhibit improved soap scum repellency behavior compared to untreated articles.

20 Claims, No Drawings

POLYMERIC SURFACE TREATMENT COMPOSITIONS

REFERENCE TO RELATED APPLICATIONS

This application is a continuation-in-part application of U.S. patent application Ser. No. 10/263,605 filed on Oct. 2, 2002, now issued, as U.S. Pat. No. 6,926,745, which is a continuation-in-part of U.S. patent application Ser. No. 10/150,363 filed on May 17, 2002, now abandoned, all of which are hereby incorporated herein by reference.

FIELD OF THE INVENTION

The invention is directed to treated articles with improved water sheeting and soap scum repellency resulting from forming hydroscopic films on the surfaces of hydrophobic polymeric substrates treated with compositions, kits and methods that employ water-soluble or water-dispersible copolymers. Thus, normally hydrophobic surfaces such as those found for example on plastic, polymeric substrates and articles bearing polymeric surfaces, will shed water and remain cleaner for longer periods of time when exposed to hard water, soap scum and oily soils.

BACKGROUND OF THE INVENTION

Consumers are dissatisfied with their cleaner's ability to prevent soils, such as soap scum, toothpaste, hard water, greasy soils, brake dust, grime, rust, and toilet ring, from building up on household surfaces. Specifically, consumers want surfaces to maintain their cleaned look for longer periods of time.

One approach to solving this problem entails applying a sacrificial layer of material which is dissolvable by water with the attendant removal of dirt. Suitable cleaning formulations must be carefully applied in order to create a sufficiently thick, dry sacrificial film. Unfortunately, inconsistent consumer cleaning habits make this an almost impossible task. In many cases, the surface is rinsed before the film is dried thereby creating a sacrificial coating that is too thin to prevent soils from adhering. In cases where the sacrificial coating is too thick, an unsightly macroscopic film with visible residue is created.

U.S. Pat. No. 6,331,517 to Durbut describes an aqueous glass cleaning composition comprising an anionic surfactant and a hydrophilic, anionic maleic acid-olefin copolymer. The surface becomes hydrophilic such that the initial contact angle of water on the treated surface is from 12 to 23 degrees. While the presence of the copolymer yields an efficient hydrophilic surface coating, this sacrificial coating is easily rinsed away unless it is very thick.

U.S. Pat. No. 6,242,046 to Nakane et al. describes a more permanent stain-proofing treatment that employs a non-water soluble resin and a metal oxide sol. With this treatment, the surface must be washed with water before the film dries on the surface. This step appears to homogeneously spread a stain-proof-treating agent on the surface and removes excess stain-proof-treating agents. When washing with water is not done properly, however, the excess causes surface non-uniformity.

WO 00/77143 to Sherry et al. describes a surface substantive polymer which purportedly renders treated surfaces hydrophilic. The preferred polymers include a copolymer of N-vinylimidazole N-vinylpyrrolidone (PVPVI), a quaternized vinyl pyrrolidone/dialkylaminoalkyl acrylate or methacrylate copolymer, or a polyvinylpyridine-N-oxide homopolymer. These polymers are purported to modify the surface to achieve water to treated surface contact angles of less than 50 degrees.

U.S. Pat. No. 6,251,849 to Jeschke et al. describes a cleaner for easier next time cleaning that contains a cationic polymer comprising at least 40 mole percent of a quaternary monomer such as methacrylamidopropyl trimethylammonium chloride. The cleaning performance is said to improve with the presence of these polymers in the cleaner but it is expected that the wetting properties will decline after a single rinse step.

A second approach to preventing soil buildup is to deposit a release aid on the treated surface to modify surface characteristics. Unfortunately, the application of cleaner or water causes the soluble release aid to be completely removed. WO 02/18531 to Ashcroft et al. describes the use of cleaning solutions containing antioxidants that function as soil release agents. The antioxidants are purportedly retained on the surface so that soil subsequently deposited thereon is prevented from polymerizing thereby allowing for easier removal. However, it is expected that the antioxidants will not be effective on all soil types.

WO 00/29538 to Baker et al. describes a non-greasy sacrificial coating containing cellulose or gum and a release aid, such as lecithin. While this coating prevents sticking, its visual appearance makes it unsuitable for glass, counter-tops, showers and the like.

In view of the deficiencies of past endeavors in developing cleaning compositions that leave satisfactory low maintenance treated surfaces, the art is in search of cleaning and/or treatment compositions that provide a thin, stable invisible film that facilitates removal of a variety of soils. The treatment composition should be suitable for household surfaces and should be rapidly adsorbed on the surface to yield a uniform film that causes water to sheet off and oil to roll off.

SUMMARY OF THE INVENTION

The present invention is based in part on the discovery of treatment compositions which cause treated articles, particularly articles of polymeric substrates that otherwise have hydrophobic surfaces, to exhibit excellent water-sheeting, soap scum and oil-repellency. In addition, the water-sheeting, soap scum and oil-repellency characteristics of such treated articles remain in effect even after the treated surface is repeatedly challenged with water, even water containing high hardness levels, soap scum and oils. Treatment compositions and kits containing copolymers used according to the methods of the present invention develop a thin hydroscopic film of the copolymer on the surface of the treated articles, thereby changing the surface properties from hydrophobic to hydrophilic. Thus by using the inventive treatment composition, a consumer is able to attain a "next time easier cleaning" benefit, in which the consumer needs only use water, for example, in a sponge or paper towel to clean a "liquid oil" or "body soil" or water soluble soil from the treated surface. Consumers will notice the water sheeting and the improved water drainage that are attendant to treated polymeric articles. The efficient drainage of water from the surfaces of the treated articles results in a mechanical transport of dirt particles, soap and soap scum particles off non-horizontal surfaces, keeping them "cleaner, longer". These benefits are derived from the adsorbed layer of copolymer that retards oil drop spreading and increases wetting by water exposure. The hydroscopic films formed on treated articles, while showing surprising resistance to the effects of water and soil challenge, are non-permanent and so enable soiled treated articles to be more easily cleaned with the subsequent deposition of a fresh layer of copolymer for renewed protection benefits.

In one aspect, the invention is directed to a treated article comprising: A treated article comprising: (a) a polymeric substrate; and (b) a hydroscopic film formed on a surface of said polymeric substrate, wherein said hydroscopic film comprises a water-soluble or water-dispersible copolymer having: (i) a first monomer capable of forming a cationic charge on protonation, wherein the first monomer is selected from the group consisting of an alkylamino acrylate, alkylaminoalkyl acrylate, alkylaminoalkyl alkylacrylate, dialkylaminoacrylate, dialkylaminoalkyl acrylate and dialkylaminoalkyl alkylacrylate; (ii) at least one of a second monomer that is acidic and that is capable of forming an anionic charge in the compositions; (iii) optionally, a third monomer that has an uncharged hydrophilic group; and (iv) optionally, a fourth monomer that is hydrophobic, wherein said treated article exhibits a Water Sheeting Index of greater than 6.

Suitable articles include those constructed of or having treatable surfaces or coatings made of hydrophobic polymeric substrates, including for example plastics and polymeric articles that are commonly found in and around the home, in kitchens, bathrooms and associated fixtures.

In another aspect, the invention is directed to a method for preparing a treated article, comprising the steps of: (1) providing a polymeric substrate; and (2) applying a liquid treatment composition to said polymeric substrate that comprises: (a) a water-soluble or water-dispersible copolymer having: (i) a first monomer capable of forming a cationic charge on protonation, wherein the first monomer is selected from the group consisting of an alkylamino acrylate, alkylaminoalkyl acrylate, alkylaminoalkyl alkylacrylate, dialkylaminoacrylate, dialkylaminoalkyl acrylate and dialkylaminoalkyl alkylacrylate; (ii) at least one of a second monomer that is acidic and that is capable of forming an anionic charge in the compositions; (iii) optionally, a third monomer that has an uncharged hydrophilic group; and (iv) optionally, a fourth monomer that is hydrophobic; (b) a surfactant; (c) optionally, an organic solvent; (d) optionally, an adjunct; and (3) removing said liquid treatment composition from said substrate to leave a treated article, wherein said treated article exhibits a Water Sheeting Index of greater than 6.

In another aspect, the invention is directed to a method for preparing a treated article, comprising the steps of: (1) providing a polymeric substrate; and (2) applying a liquid treatment composition to said polymeric substrate that comprises: (a) a water-soluble or water-dispersible copolymer to form an invisible film on the surface of the treated polymeric substrate that is less than 400 nanometers in thickness.

Suitable adjuncts include, for example, buffering agents, builders, hydrotropes, fragrances, dyes, colorants, solubilizing materials, stabilizers, thickeners, defoamers, enzymes, bleaching agents, cloud point modifiers, preservatives, and mixtures thereof.

In yet another embodiment, the invention is directed to a kit for treating a polymeric substrate to provide a treated article comprising: (a) a liquid treatment composition comprising: (1) a water-soluble or water-dispersible copolymer having: (i) a first monomer capable of forming a cationic charge on protonation, wherein the first monomer comprises an R1,R2-(amino-R3)-R4-acrylate; wherein R1, R2, R3 and R4 are substituents independently selected from the group consisting of H—, C1 to C8 alkyl radical, C1 to C8 alkylene radical, vinyl radical, aryl radical, isomers thereof, derivatives thereof, and combinations thereof, (ii) at least one of a second monomer that is acidic and that is capable of forming an anionic charge in the compositions; (iii) optionally, a third monomer that has an uncharged hydrophilic group; and (iv) optionally, a fourth monomer that is hydrophobic; (2) a surfactant; (3) optionally, an organic solvent; (4) optionally, an adjunct; and; (b) instructions for treating said polymeric substrate by application of said liquid treatment composition, wherein said treated article exhibits a Water Sheeting Index of greater than 6.

In another embodiment, the copolymer film formed on the surface of the hydrophobic polymeric substrate yields a treated article exhibiting a Water Sheeting Index of greater than 20. In yet another embodiment, the copolymer film formed on the surface of the hydrophobic polymeric substrate yields a treated article exhibiting a Water Sheeting Index of greater than 30.

In yet another embodiment, the copolymer film formed on the surface of the hydrophobic polymeric substrate yields a treated article exhibiting a Water Sheeting Index of greater than 6, and further exhibiting an improved soap scum repellency performance. In a further embodiment, the copolymer film formed on the surface of the hydrophobic polymeric substrate is invisible to the human eye and is less than 400 nanometers thick, yet provides improved water sheeting and soap scum repellancy to the treated polymeric substrate as compared to an untreated surface.

DETAILED DESCRIPTION OF THE INVENTION

The treated article of the present invention comprises: (a) a polymeric substrate; and (b) a hydroscopic film formed on a surface of said polymeric substrate, wherein the hydroscopic film comprises a water-soluble or water-dispersible copolymer having:

(i) a first monomer capable of forming a cationic charge on protonation, wherein the first monomer is selected from the group consisting of an alkylamino acrylate, alkylaminoalkyl acrylate, alkylaminoalkyl alkylacrylate, dialkylaminoacrylate, dialkylaminoalkyl acrylate and dialkylaminoalkyl alkylacrylate;

(ii) at least one of a second monomer that is acidic and that is capable of forming an anionic charge in the compositions;

(iii) optionally, a third monomer that has an uncharged hydrophilic group; and (iv) optionally, a fourth monomer that is hydrophobic, wherein said treated article exhibits a Water Sheeting Index of greater than 6.

Copolymer

The copolymer includes at least one first monomer that is capable of forming a cationic charge on protonation, which is to say the ability to become partially or fully charged upon formulation in an aqueous environment providing a source of protons or hydronium ions ($H_3O^+$). The first monomer may be selected from the group consisting of an alkylamino acrylate, alkylaminoalkyl acrylate, alkylaminoalkyl alkylacrylate, dialkylaminoacrylate, dialkylaminoalkyl acrylate and dialkylaminoalkyl alkylacrylate, and combinations thereof. Without being bound by theory, it is believed that these monomers become sufficiently cationically charged by protonation to exhibit characteristic hydrophilic wetting properties of a charged monomer species, particularly when present in a copolymer with a second monomer bearing an oppositely charged group. Further, these first monomers exhibit the ability to interact or associate with normally hydrophobic substrates, such as polymeric substrates including plastics, rendering copolymers containing a sufficient degree of first monomer content capable of attaching to the polymeric substrates. Suitable first monomers include those described as R1,R2-(amino-R3)-R4-acrylate monomers, in either their salt or acidic forms, wherein R1, R2, R3 and R4 are substituents independently selected from the group consisting of H—, C1 to C8 alkyl radical, C1 to C8 alkylene radical, vinyl radical, aryl radical, isomers thereof, derivatives thereof, and combinations thereof. Suitable first monomer examples include, but are not limited to either the salt or acid forms of methylaminoacrylate, dimethylaminoacrylate, dimethyl aminomethacrylate, dimethyl aminomethylmethacrylate, dimethylaminoethyl acrylate, dimethylaminoethylmethacrylate, dimethylaminoethylethacrylate, dimethylaminobutylacrylate, dimethylaminobutylmethacrylate, dimethylaminopropylacrylate, dimethylaminopropylmethacrylate, ethylaminoacrylate, diethylaminoacrylate, diethylaminomethacrylate, diethylaminoethylmethacrylate, diethylaminoethacrylate, diethylaminoethylethacrylate, diethylaminobutylacrylate, diethylaminobutylmethacrylate, diethylaminopropylacrylate, diethylaminopropyl methacrylate, diethylaminopropylethacrylate, n-propylaminoacrylate, n-propylamino-methacrylate, n-propylaminomethylmethacrylate, di-n-propylaminoacrylate, di-n-propylaminomethacrylate, di-n-propylaminomethylmethacrylate, isopropylaminoacrylate, isopropylaminomethacrylate, isopropylaminoethacrylate, isopropylaminomethylmethacrylate, isopropylaminoethylmethacrylate, di-isopropylaminoacrylate, di-isopropylamino-methylacrylate, di-isopropylaminomethylmethacrylate, di-isopropylaminoethylacrylate, di-isopropylaminoethylmethacrylate, di-isopropylaminoethylethacrylate, di-isopropylaminopropylacrylate, di-isopropylaminopropylmethacrylate, di-isopropylaminopropylethacrylate, di-isopropylaminobutylacrylate, di-isopropylaminobutylmethacrylate, di-isopropylaminobutylethacrylate, butylaminoacrylate, dibutylaminoacrylate, dibutylaminomethacrylate, dibutylaminomethylmethacrylate, butylaminomethyl acrylate, dibutylaminomethyl methacrylate, dibutylaminoethacrylate, dibutylaminoethylmethacrylate, dibutylaminoethylethacrylate, pentylaminoacrylate, pentylaminomethacrylate, pentylaminomethyl acrylate, pentylaminomethylmethacrylate, pentylaminoethacrylate, pentylaminomethylethacrylate, pentylaminoethylethacrylate, hexylaminoacrylate, hexylaminomethacrylate, hexylaminomethyl acrylate, hexylaminomethylmethacrylate, hexylaminoethacrylate, hexylaminomethylethacrylate, hexylaminoethylethacrylate, dihexylaminoacrylate, dihexylaminomethacrylate, dihexylaminomethyl acrylate, dihexylaminomethylmethacrylate, dihexylaminoethacrylate, dihexylaminomethylethacrylate, dihexylaminoethylethacrylate, heptylaminoacrylate, heptylaminomethacrylate, heptylaminomethyl acrylate, heptylaminomethylmethacrylate, heptylaminoethacrylate, heptylaminomethylethacrylate, heptylaminoethylethacrylate, diheptylaminoacrylate, diheptylaminomethacrylate, diheptylaminomethyl acrylate, diheptylaminomethylmethacrylate, diheptylaminoethacrylate, diheptylaminomethylethacrylate, diheptylaminoethylethacrylate, octylaminoacrylate, octylaminomethacrylate, octylaminomethyl acrylate, octylaminomethylmethacrylate, octylaminoethacrylate, octylaminomethylethacrylate, octylaminoethylethacrylate, dioctylaminoacrylate, dioctylaminomethacrylate, dioctylaminomethyl acrylate, dioctylaminomethylmethacrylate, dioctylaminoethacrylate, dioctylaminomethylethacrylate, dioctylaminoethylethacrylate, and isomers thereof. Additional monomers include, but are not limited to those monomers having one or more aryl substituents, for example benzylaminoethyl acrylate, dibenzylaminoethyl acrylate, diphenylaminoethylmethacrylate, diphenylaminophenyl acrylate and dimethylaminophenyl methacrylate. Additional monomers include, but are not limited to those monomers having one or more vinyl substituents or alkenyl substituents with one or more unsaturated carbon-carbon double bond(s), for example vinylaminomethyl acrylate, divinylaminoethyl methacrylate and di-(2-hexylene) amino acrylate.

Monomers that are cationic on protonation typically contain a positive charge over a portion of the pH range of 2-11. Such suitable monomers are also presented in *Water-Soluble Synthetic Polymers: Properties and Behavior*, Volume II, by P. Molyneux, CRC Press, Boca Raton, 1983, ISBN 0-8493-6136. Additional monomers can be found in the *International Cosmetic Ingredient Dictionary* , 5th Edition, edited by J. A. Wenninger and G. N. McEwen, The Cosmetic, Toiletry, and Fragrance Association, Washington D.C., 1993, ISBN 1-882621-06-9. A third source of such monomers can be found in *Encyclopedia of Polymers and Thickeners for Cosmetics*, by R. Y. Lochhead and W. R. Fron, Cosmetics & Toiletries, vol. 108, May 1993, pp 95-135. All three references are incorporated herein in their entirety or of those cited pages of the references provided herein.

Examples of acidic monomers that are capable of forming an anionic charge in the composition include, but are not limited to acrylic acid, methacrylic acid, ethacrylic acid, dimethylacrylic acid, maleic anhydride, succinic anhydride, vinylsulfonate, cyanoacrylic acid, methylenemalonic acid, vinylacetic acid, allylacetic acid, ethylidineacetic acid, propylidineacetic acid, crotonoic acid, fumaric acid, itaconic acid, sorbic acid, angelic acid, cinnamic acid, styrylacrylic acid, citraconic acid, glutaconic acid, aconitic acid, phenylacrylic acid, acryloxypropionic acid, aconitic acid, phenylacrylic acid, acryloxypropionic acid, vinylbenzoic acid, N-vinylsuccinamidic acid, mesaconic acid, methacroylalanine, acryloylhydroxyglycine, sulfoethyl methacrylic acid, sulfopropyl acrylic acid, sulfonic acid, styrenesulfonic acid, sulfoethylacrylic acid, 2-methacryloyloxymethane-1-sulfonic acid, 3-methacryoyloxypropane-1-sulfonic acid, 3-(vinyloxy)propane-1-sulfonic acid, ethylenesulfonic acid, vinyl sulfuric acid, 4-vinylphenyl sulfuric acid, ethylene phosphonic acid, vinyl phosphoric acid, 2-acrylamido-2-methyl-1-propanesulfonic acid, and mixtures thereof. Also suitable as the second monomer are the salt forms of the preceding examples, including for example, but not limited to sulfoethyl methacrylate, sulfopropyl acrylate and sulfoethyl acrylate.

Preferred acid monomers also include styrenesulfonic acid, 2-methacryloyloxymethane-1-sulfonic acid, 3-methacryloyloxypropane-1-sulfonic acid, 3-(vinyloxy)propane-1-sulfonic acid, ethylenesulfonic acid, vinyl sulfuric acid, 4-vinylphenyl sulfuric acid, ethylene phosphonic acid, vinyl phosphoric acid, acrylamide methyl propanesulfonic acid, 2-(sulfooxy)ethyl methacrylate ammoniate, 2-hydroxyethylmethacrylate and 2-acrylamido-2-methyl-1-propanesulfonic acid. The copolymers useful in this invention may contain the above acidic monomers in acidic form or associated as salts with water soluble cationic counterions, including the alkali metal, alkaline earth metal, and ammonium cations and salts thereof.

Examples of optional third monomers that have an uncharged hydrophilic group include, but are not limited to, vinyl alcohol, vinyl acetate, vinyl methyl ether, vinyl ethyl ether, ethylene oxide, propylene oxide, hydroxymethacrylate, hydroxyethacrylate, hydroxypropyl acrylate, alkylpolyglycoside esters, and polyethylene glycol esters of acrylic acid, polyethylene glycol esters of methacrylic acid, and mixtures thereof.

Examples of optional fourth hydrophobic monomers include, but are not limited to, $C_{1-4}$ alkyl esters of acrylic acid and of methacrylic acid, allyl methacrylate, isobornyl methacrylate, and mixtures thereof.

The copolymers are formed by copolymerizing the desired monomers. Conventional polymerization techniques can be employed. Illustrative techniques include, for example, solution, suspension, dispersion, or emulsion polymerization. A preferred method of preparation is by precipitation or inverse suspension polymerization of the copolymer from a polymerization media in which the monomers are dispersed in a suitable solvent. The monomers employed in preparing the copolymer are preferably water soluble and sufficiently soluble in the polymerization media to form a homogeneous solution. They readily undergo polymerization to form polymers which are water-dispersible or water-soluble. Suitable synthetic methods for these copolymers are described, for example, in Kirk-Othmer, *Encyclopedia of Chemical Technology*, Volume 1, Fourth Ed., John Wiley & Sons.

The level of the first monomer, which is capable of forming a cationic charge on protonation, is typically between 3 and 80 mol % and preferably 10 to 60 mol % of the copolymer. The level of second monomer, which is an acidic monomer that is capable of forming an anionic charge in the composition, when present is typically between 3 and 80 mol % and preferably 10 to 60 mol % of the copolymer. The level of the third monomer, which has an uncharged hydrophilic group, when present is typically between 3 and 80 mol % and preferably 10 to 60 mol % of the copolymer. When present, the level of uncharged hydrophobic monomer is less than about 50 mol % and preferably less than 10 mol % of the copolymer. The molar ratio of the first monomer to the second monomer typically ranges from 19:1 to 1:10, and in other embodiments may range from 10:1 to 1:10. The molar ratio of the first monomer to the third monomer in yet another embodiment may range from 10:1 to 1:10, and additionally may range from 4:1 to 1:4, or alternatively may range from 2:1 to 1:2. The molar ratio of the first monomer to the fourth monomer in yet another embodiment may range from 10:1 to 1:10, and additionally may range from 4:1 to 1:4, or alternatively may range from 2:1 to 1:2.

Various ratios of the first and second monomers, and optionally a third monomer, and/or optionally a fourth monomer, in the copolymer will effect the overall water solubility and water dispersibility of the copolymer, and may be tuned to provide suitable dispersing properties while delivering the desired hydrophilic filming characteristic to a treated polymeric substrate to produce an overall water sheeting effect owing to the presence of the copolymer on the surface of the substrate.

The average molecular weight of the copolymer typically ranges from about 5,000 to about 10,000,000, with the preferred molecular weight range depending on the polymer composition with the proviso that the molecular weight is selected so that the copolymer is water soluble or water dispersible to at least 0.001% by weight in distilled water at 25° C.

In some embodiments, the copolymer may constitute 0.001 to 20%, preferably 0.005 to 10%, and most preferably 0.01 to 5% of the treatment composition. (All percentages herein are on a weight basis unless noted otherwise.)

Treating Hydrophobic Surfaces

The inventive copolymers can be applied to articles composed of hydrophobic polymeric substrates to form a hydroscopic film on their surface which renders the surface hydrophilic and thereby capable of exhibiting improved water sheeting and soap scum repellency, even after prolonged and/or repetitive challenges by water, soap scum and oily soils. The kits and compositions employing the inventive copolymers, and methods as described herein, provide for treated articles of these polymeric substrates with hydroscopic films formed on their surfaces that can also provide for "easier cleaning" and "next time cleaning" benefits.

In one embodiment, a method for preparing a treated article comprises the steps of: (1) providing a polymeric substrate; and (2) applying a liquid treatment composition to the polymeric substrate that comprises (a) the water-soluble or water-dispersible copolymer in combination with (b) a surfactant; (c) optionally, an organic solvent; (d) optionally, an adjunct; and then (3) removing the liquid treatment composition from the substrate to leave a treated article exhibiting a Water Sheeting Index of greater than 6. In a second embodiment, a liquid treatment composition comprising a solution of the copolymer in an aqueous medium without any surfactant or other adjuncts can be reapplied to a previously treated surface bearing a hydroscopic copolymer film in order to restore or renew the film on the surface.

In another embodiment, step (3) of the above process involves removing the liquid treatment composition by means of an additional step of rinsing the treated substrate with water.

Polymeric Substrates

Articles treated according to the inventive methods and compositions as described herein may be selected from those articles of construction comprising polymeric substrates that normally exhibit hydrophobic surface properties in that they exhibit the tendency to bead water when water is applied to their untreated surfaces. Articles include those wholly constructed of, laminated with, and/or coated with a hydrophobic polymeric substrate.

Polymeric substrates include condensed polymers which are rendered into materials of construction having at least one treatable surface. These polymeric substrates can be in any physical form, for example, but are not limited to, panels, molded forms, foams, sheets, solid surfaces, laminated films and coatings on a secondary substrate, and the like. The polymeric substrates may have any desired physical properties, for example, but not limited to, forms that are substantially elastic, non-elastic, flexible, compressible, or essentially rigid, and combinations thereof.

Suitable articles of the present invention include those constructs and articles of construction typically found in and around the home and commercial environments featuring at least one treatable surface comprising a hydrophobic polymeric substrate, including for example, but are not limited to, plastics, elastomers and laminates used in the construction of floors, tiles, panels, walls, doors, ceilings, bathtubs, shower stalls, sinks, cabinets, countertops, fixtures, and the like.

Suitable polymeric substrates and articles constructed thereof, include, but are not limited to polyethylene terephthalate, polyamide, polyurethane, polyester, polyethylene, polyvinyl chloride (PVC), chlorinated polyvinylidene chloride, polyacrylamide, polystyrene, polypropylene, polycarbonate, polyaryletherketone, poly(cyclohexylene dimethylene cyclohexanedicarboxylate), poly(cyclohexylene dimethylene terephthalate), poly(cyclohexylene dimethylene terephthalate) glycol, polyetherimide, polyethersulfone, poly (ethylene terephthalate) glycol, polyketone, poly(oxymethylene), polyformaldehyde, poly(phenylene ether), poly(phenylene sulfide), poly(phenylene sulfone), polystyrene, polysulfone, polytetrafluoroethylene, polyurethane, poly(vinylidene fluoride), polyamide, polyamide thermoplastic elastomer, polybutylene, polybutylene terephthalate, polypropylene terephthalate, polyethylene naphthalate, polyhydroxyalkanoate, polyacrylate, poly(methyl)methacrylate (PMMA), polytrimethylene terephthalate, polyvinylidene chloride and combinations thereof.

Suitable polymeric substrates and articles constructed thereof further include copolymeric materials made of one or more monomers selected from acrylate, acrylonitrile, butadiene, ethylene, formaldehyde, maleic anhydride, melamine, methacrylate, methyl methacrylate, phenol, propylene, styrene, urethane, and vinyl acetate. Specific examples of these copolymeric materials (and their common industrial acronyms) include acrylonitrile:butadiene:styrene (ABS), acrylonitrile:styrene:acrylate (ASA), ethylene:propylene (E/P), ethylene:vinyl acetate (EVAC), methyl methacrylate:acrylonitrile:butadiene:styrene (MABS), methacrylate:butadiene:styrene (MBS), melamine:formaldehyde (MF), melamine:phenol:formaldehyde (MPF), phenol:formaldehyde (PF), styrene:butadiene (SB), styrene:maleic anhydride (SMAH), styrene:acrylonitrile (SAN), styrene:butadiene (SBC), vinyl acetate:ethylene copolymer (VAE), and combinations thereof.

Also suitable are polymeric substrates and articles constructed of thermoplastic elastomers including, but not limited to, copolyester thermoplastic elastomer (TPC), olefinic thermoplastic elastomer (TPO), styrenic thermoplastic elastomer (TPS), urethane thermoplastic elastomer (TPU), thermoplastic rubber vulcanisate (TPV), rubber, neoprene, vinyl, silicone elastomer, and combinations thereof.

Aqueous Carrier

The compositions of the present invention preferably comprise an aqueous liquid carrier that includes water and optionally one or more organic solvents. Water typically comprises from about 50% to 100%, preferably from about 60% to about 98%, and more preferably from about 80% to about 96% of the aqueous carrier, with the optional solvent forming the balance. Deionized or softened water is preferred.

In preferred low-surfactant compositions for use in no-rinse cleaning, the aqueous carrier typically comprise about 98% to about 99.99%, preferably from about 99% to about 99.99%, and more preferably from about 99.5% to about 99.99%, of the compositions.

The solvent is typically used to dissolve various components in the improved treatment composition so as to form a substantially uniformly dispersed mixture. The solvent can also function as (i) a cleaning agent to loosen and solubilize greasy or oily soils from surfaces, (ii) a residue inhibiting agent to reduce residues left behind on a cleaned surface, (iii) a detergent agent, (iv) a disinfecting, sanitizing, and/or sterilizing agent, and/or (v) drying aid to either lengthen or shorten the drying period following application of the inventive treatment compositions to polymeric substrates.

The solvent, when used, can be premixed with the other components of the treatment composition or be partially or fully added to the improved treatment composition prior to use. The solvent may be water soluble and/or it is a water dispersible organic solvent. The solvent can be selected to have the desired volatility depending on the cleaning application.

Suitable solvents include, but are not limited to, $C_{1-6}$ alkanols, $C_{1-6}$ diols, $C_{1-10}$ alkyl ethers of alkylene glycols, $C_{3-24}$ alkylene glycol ethers, polyalkylene glycols, short chain carboxylic acids, short chain esters, isoparafinic hydrocarbons, mineral spirits, alkylaromatics, terpenes, terpene derivatives, terpenoids, terpenoid derivatives, formaldehyde, and pyrrolidones. Alkanols include, but are not limited to, methanol, ethanol, n-propanol, isopropanol, butanol, pentanol, and hexanol, and isomers thereof. Diols include, but are not limited to, methylene, ethylene, propylene and butylene glycols. Alkylene glycol ethers include, but are not limited to, ethylene glycol monopropyl ether, ethylene glycol monobutyl ether, propylene glycol n-propyl ether, propylene glycol monobutyl ether, propylene glycol t-butyl ether, diethylene glycol monoethyl or monopropyl or monobutyl ether, di- or tri-polypropylene glycol methyl or ethyl or propyl or butyl ether, acetate and propionate esters of glycol ethers. Short chain carboxylic acids include, but are not limited to, acetic acid, glycolic acid, lactic acid and propionic acid. Short chain esters include, but are not limited to, glycol acetate. Water insoluble solvents such as isoparafinic hydrocarbons, mineral spirits, alkylaromatics, terpenoids, terpenoid derivatives, terpenes, terpenes derivatives, cyclic and/or linear volatile siloxanes and their derivatives, can be mixed with a water soluble solvent when employed.

When water insoluble solvents are mixed with a water soluble solvent for the treatment composition, the amount of the water insoluble solvent in the treatment composition is generally less than about 10% typically less than about 5% and more typically less than about 1% of the treatment composition. As can be appreciated, the treatment composition can be a non-aqueous cleaner wherein little, if any, water is used. In such formulations, amount of the water insoluble solvent can be greater than about 10%.

Suitable water insoluble solvent includes, but is not limited to, tertiary alcohols, hydrocarbons (e.g. alkanes), pine-oil, terpinoids, turpentine, turpentine derivatives, terpenoid derivatives, terpinolenes, limonenes, pinenes, terpene derivatives, benzyl alcohols, phenols, and their homologues. Certain terpene derivatives that can be used include, but are not limited to, d-limonene, and dipentene. Pyrrolidones include, but are not limited to, N-methyl-2-pyrrolidone, N-octyl-2-pyrrolidone and N-dodecyl-2-pyrrolidone. In one particular formulation of the treatment composition, the solvents can include, but are not limited to, n-propanol, isopropanol, butanol, ethyleneglycol butylether, diethyleneglycol butylether, propyleneglycol butylether, dipropyleneglycol butylether, and/or Hexyl Cellusolve™. In another particular preferred formulation, the solvent includes isopropanol and/or propyleneglycol butylether.

Typically, the treatment composition may include at least about 0.5% solvent to avoid solubility problems which can result from the combination of various components of the treatment composition. The amount of the solvent in the treatment composition may exceed about 70% when formulated as a concentrate.

Surfactant

The treatment composition may include an effective amount of surfactant for (i) improving the cleaning performance (e.g., by improving wetting properties), (ii) stabilizing treatment composition, and (iii) emulsifying the cleaning components. Conventional anionic, cationic, zwitterionic, and/or amphoteric surfactants can be employed. Suitable surfactants are described in *McCutcheon's Emulsifiers and Detergents* (1997), Kirk-Othmer, Encyclopedia of Chemical Technology, 3rd Ed., Volume 22, pp. 332-432 (Marcel-Dekker, 1983), and *McCutcheon's Soaps and Detergents* (N. Amer. 1984), which are incorporated herein by reference.

Suitable surfactant includes, but is not limited to, glycoside, glycols, ethylene oxide and mixed ethylene oxide/propylene oxide adducts of alkylphenols and alcohols, the ethylene oxide and mixed ethylene oxide/propylene oxide adducts of long chain alcohols or of fatty acids, mixed ethylene oxide/propylene oxide block copolymers, esters of fatty acids and hydrophilic alcohols, sorbitan monooleates, alkanolamides, soaps, alkylbenzene sulfonates, olefin sulfonates, paraffin sulfonates, propionic acid derivatives, alcohol and alcohol ether sulfates, phosphate esters, amines, amine oxides, alkyl sulfates, alkyl ether sulfates, sarcosinates, sulfoacetates, sulfosuccinates, cocoamphocarboxy glycinate, salts of higher acyl esters of isethionic acid, salts of higher acyl derivatives of taurine or methyltaurine, phenol poly ether sulfates, higher acyl derivatives of glycine and methylglycine, alkyl aryl polyether alcohols, salts of higher alkyl substituted imadazolinium dicarboxylic acids, tannics, naphthosulfonates, monochloracetics anthraflavinics, hippurics, anthranilics, naphthoics, phthalics, carboxylic acid salts, acrylic acids, phosphates, alkylamine ethoxylates, ethylenediamine alkoxylates, betaines, sulfobetaines, and imidazolines.

Lauryl sulfate, laurylether sulfate, cocamidopropylbetaine, alkyl polyglycosides, and amine oxides can also be employed as surfactants. The amine oxides can be ethoxylated and/or propoxylated. One specific amine oxide includes, but is not limited to, alkyl di (hydroxy lower alkyl) amine oxides, alkylamidopropyl di (lower alkyl) amine oxides, alkyl di (lower alkyl) amine oxides, and/or alkylmorpholine oxides, wherein the alkyl group has 5-25 carbons and can be branched, unbranched, saturated, and/or unsaturated. Nonlimiting examples of amine oxides include, but are not limited to, lauryl amine oxide sold under the name BARLOX 12 from Lonza.

The alkyl polyglycosides is typically formed by reacting a sugar with a higher alcohol in the presence of an acid catalyst, or by reacting a sugar with a lower alcohol (for example, methanol, ethanol, propanol, butanol) to thereby provide a lower alkyl glycoside, which is then reacted with a higher alcohol. The higher alcohol generally has the formulation $R_1O(R_2O)_XH$, wherein $R_1$ represents a straight or branched alkyl, alkenyl, or alkylphenyl group having from 2 to 30 carbon atoms, $R_2$ represents an alkylene group having from 2 to 20 carbon atoms, and X is a mean value that is 0 to 10. Specific non-limiting examples of the higher alcohol are straight or branched alkanol such as hexanol, heptanol, octanol, nonanol, decanol, dodecanol, tridecanol, tetradecanol, pentadecanol, hexadecanol, heptadecanol, octadecanol, methylpentanol, methylhexanol, methylheptanol, methyloctanol, methyldecanol, methylundecanol, methyltridecanol, methylheptadecanol, ethylhexanol, ethyloctanol, ethyldecanol, ethyldodecanol, 2-heptanol, 2-nonanol, 2-undecanol, 2-tridecanol, 2-pentadecanol, 2-heptadecanol, 2-butyloctanol, 2-hexyloctanol, 2-octyloctanol, 2-hexyldecanol and/or 2-octyldecanol; an alkenol such as hexenol, heptenol, octenol, nonenol, decenol, undecenol, dodecenol, tridecenol, tetradecenol, pentadecenol, hexadecenol, heptadecenol and octadecenol, and alkylphenols such as octylphenol and nonylphenol. These alcohols or alkylphenols may be used either alone or a mixture of two or more of them.

Further, an alkylene oxide adduct of these alcohols or alkylphenols can be used. The sugar used to form the alkyl glycoside includes, but is not limited to, monosaccharides, oligosaccharides, and polysaccharides. Nonlimiting examples of the monosaccharides include aldoses such as, but not limited to, allose, altrose, glucose, mannose, gulose, idose, galactose, talose, ribose, arabinose, xylose, and lyxose. Nonlimiting examples of the oligosaccharides include maltose, lactose, sucrose and maltotriose. Nonlimiting examples of the polysaccharides include hemicellulose, insulin, dextrin, dextran, xylan, starch and/or hydrolyzed starch. Specific alkyl glycosides that can be used are represented by the following formula: $D_1O(D_2O)_XH_Y$ wherein $D_1$ is an alkyl, alkenyl, or alkylphenyl group having from 6 to 30 carbon atoms, $D_2$ is an alkylene group having from 2 to 20 carbon atoms, H is a residual group originating from a reducing sugar having 2 or 10 carbon atoms, X is a mean value that is 0 to 10, and Y is a mean value that is 1 to 10. Nonlimiting examples of alkyl polyglycosides include, but are not limited to, APG series alkyl polyglycosides from Cognis.

Surfactants may also include ethoxylated alcohols having an alkyl group typically with 6-22 carbons; the alkyl group is preferably linear but could be branched. Furthermore, the carbon groups can be saturated or unsaturated. Suitable ethoxylated alcohols include the SURFONIC L series surfactants by Huntsman. Fluorosurfactants can also be used as the surfactant. A suitable fluorosurfactant is an ethoxylated nonionic fluorosurfactant. Suitable ethoxylated nonionic fluorosurfactants include the ZONYL surfactants by DuPont.

Typically the surfactant is partially or fully soluble in water. When employed, the surfactant comprises at least about 0.001% and typically 0.01 to 10% of the treatment composition. The amount of surfactant may exceed 10% when the treatment composition is formulated in concentrate. Preferably, the surfactant content is about 0.1 to 2%. An effective amount of surfactant is a level of surfactant sufficient in allowing a treatment composition containing the copolymer to fully wet a treated surface to spread the composition uniformly across the polymeric substrate and provide a wetted layer of composition that enables formation of a hydroscopic copolymer film on the surface of the substrate.

Antimicrobial Agent

An antimicrobial agent can also be included in the treatment composition. Non-limiting examples of useful quaternary compounds that function as antimicrobial agents include benzalkonium chlorides and/or substituted benzalkonium chlorides, di($C_6$-$C_{14}$)alkyl di short chain ($C_{1-4}$ alkyl and/or hydroxyalkyl) quaternary ammonium salts, N-(3-chloroallyl) hexaminium chlorides, benzethonium chloride, methylbenzethonium chloride, and cetylpyridinium chloride. The quaternary compounds useful as cationic antimicrobial actives are preferably selected from the group consisting of dialkyldimethyl ammonium chlorides, alkyldimethylbenzylammonium chlorides, dialkylmethylbenzylammonium chlorides, and mixtures thereof. Biguanide antimicrobial actives including, but not limited to polyhexamethylene biguanide hydrochloride, p-chlorophenyl biguanide; 4-chlorobenzhydryl biguanide, halogenated hexidine such as, but not limited to, chlorhexidine (1,1'-hexamethylene-bis-5-(4-chlorophenyl biguanide) and its salts are especially preferred. Typical concentrations for biocidal effectiveness of these quaternary compounds, especially in the preferred low-surfactant compositions herein, range from about 0.001% to about 0.8% and preferably from about 0.005% to about 0.3% of the usage composition. The weight percentage ranges for the biguanide and/or quat compounds in the treatment composition is selected to disinfect, sanitize, and/or sterilize most common household and industrial surfaces.

Non-quaternary biocides are also useful in the present compositions. Such biocides can include, but are not limited to, alcohols, peroxides, boric acid and borates, chlorinated hydrocarbons, organometallics, halogen-releasing compounds, mercury compounds, metallic salts, pine oil, organic sulfur compounds, iodine compounds, silver nitrate, quaternary phosphate compounds, and phenolics Builder/Buffer The treatment composition may include a builder detergent which increase the effectiveness of the surfactant. The builder detergent can also function as a softener and/or a sequestering and buffering agent in the treatment composition. A variety of builder detergents can be used and they include, but are not limited to, phosphate-silicate compounds, zeolites, alkali metal, ammonium and substituted ammonium polyacetates, trialkali salts of nitrilotriacetic acid, carboxylates, polycarboxylates, carbonates, bicarbonates, polyphosphates, aminopolycarboxylates, polyhydroxysulfonates, and starch derivatives.

Builder detergents can also include polyacetates and polycarboxylates. The polyacetate and polycarboxylate compounds include, but are not limited to, sodium, potassium, lithium, ammonium, and substituted ammonium salts of ethylenediamine tetraacetic acid (EDTA), ethylenediamine triacetic acid, ethylenediamine tetrapropionic acid, diethylenetriamine pentaacetic acid, nitrilotriacetic acid, oxydisuccinic acid, iminodisuccinic acid, mellitic acid, polyacrylic acid or polymethacrylic acid and copolymers, benzene polycarboxylic acids, gluconic acid, sulfamic acid, oxalic acid, phosphoric acid, phosphonic acid, organic phosphonic acids, acetic acid, and citric acid. These builder detergents can also exist either partially or totally in the hydrogen ion form.

The builder agent can include sodium and/or potassium salts of EDTA and substituted ammonium salts. The substituted ammonium salts include, but are not limited to, ammonium salts of methylamine, dimethylamine, butylamine, butylenediamine, propylamine, triethylamine, trimethylamine, monoethanolamine, diethanolamine, triethanolamine, isopropanolamine, ethylenediamine tetraacetic acid and propanolamine.

Buffering and pH adjusting agents, when used, include, but are not limited to, organic acids, mineral acids, alkali metal and alkaline earth salts of silicate, metasilicate, polysilicate, borate, carbonate, carbamate, phosphate, polyphosphate, pyrophosphates, triphosphates, tetraphosphates, ammonia, hydroxide, monoethanolamine, monopropanolamine, diethanolamine, dipropanolamine, triethanolamine, and 2-amino-2methylpropanol. Preferred buffering agents for compositions of this invention are nitrogen-containing materials. Some examples are amino acids such as lysine or lower alcohol amines like mono-, di-, and tri-ethanolamine. Other preferred nitrogen-containing buffering agents are Tri(hydroxymethyl) amino methane $(HOCH_2)_3CNH_3$ (TRIS), 2-amino-2-ethyl-1,3-propanediol, 2-amino-2-methyl-propanol, 2-amino-2-methyl-1,3-propanol, disodium glutamate, N-methyl diethanolamide, 2-dimethylamino-2-methylpropanol (DMAMP), 1,3-bis(methylamine)-cyclohexane, 1,3-diamino-propanol N,N'-tetra-methyl-1,3-diamino-2-propanol, N,N-bis(2-hydroxyethyl)glycine (bicine) and N-tris (hydroxymethyl)methyl glycine (tricine). Other suitable buffers include ammonium carbamate, citric acid, and acetic acid. Mixtures of any of the above are also acceptable. Useful inorganic buffers/alkalinity sources include ammonia, the alkali metal carbonates and alkali metal phosphates, e.g., sodium carbonate, sodium polyphosphate. For additional buffers see McCutcheon's *Emulsifiers and Detergents*, North American Edition, 1997, McCutcheon Division, MC Publishing Company Kirk and WO 95/07971 both of which are incorporated herein by reference.

When employed, the builder detergent comprises at least about 0.001% and typically about 0.01 to 5% of the treatment composition. The amount of the builder detergent may exceed about 5% when the treatment composition is formulated as a concentrate. Preferably, the builder detergent content is about 0.01 to 2%.

Additional Adjuncts

The treatment composition may include additional adjuncts. The adjuncts include, but are not limited to, fragrances or perfumes, waxes, dyes and/or colorants, solubilizing materials, stabilizers, thickeners, defoamers, hydrotropes, lotions and/or mineral oils, enzymes, bleaching agents, cloud point modifiers, preservatives, and other polymers. The waxes, when used, include, but are not limited to, carnauba, beeswax, spermaceti, candelilla, paraffin, lanolin, shellac, esparto, ouricuri, polyethylene wax, chlorinated naphthalene wax, petrolatum, microcrystalline wax, ceresine wax, ozokerite wax, and/or rezowax. The solubilizing materials, when used, include, but are not limited to, hydrotropes (e.g. water soluble salts of low molecular weight organic acids such as the sodium and/or potassium salts of xylene sulfonic acid). The acids, when used, include, but are not limited to, organic hydroxy acids, citric acids, keto acid, and the like. Thickeners, when used, include, but are not limited to, polyacrylic acid, xanthan gum, calcium carbonate, aluminum oxide, alginates, guar gum, methyl, ethyl, clays, and/or propylhydroxycelluloses. Defoamers, when used, include, but are not limited to, silicones, aminosilicones, silicone blends, and/or silicone/hydrocarbon blends. Lotions, when used, include, but are not limited to, achlorophene and/or lanolin. Enzymes, when used, include, but are not limited to, lipases and proteases, and/or hydrotropes such as xylene sulfonates and/or toluene sulfonates. Bleaching agents, when used, include, but are not limited to, peracids, hypohalite sources, hydrogen peroxide, and/or sources of hydrogen peroxide.

Preservatives, when used, include, but are not limited to, mildewstat or bacteriostat, methyl, ethyl and propyl parabens, short chain organic acids (e.g. acetic, lactic and/or glycolic acids), bisguanidine compounds (e.g. Dantagard and/or Glydant) and/or short chain alcohols (e.g. ethanol and/or IPA).

The mildewstat or bacteriostat includes, but is not limited to, mildewstats (including non-isothiazolone compounds), Kathon GC, a 5-chloro-2-methyl-4-isothiazolin-3-one, KATHON ICP, a 2-methyl-4-isothiazolin-3-one, and a blend thereof, and KATHON 886, a 5-chloro-2-methyl-4-isothiazolin-3-one, all available from Rohm and Haas Company; BRONOPOL, a 2-bromo-2-nitropropane-1,3-diol, from Boots Company Ltd., PROXEL CRL, a propyl-p-hydroxybenzoate, from ICI PLC; NIPASOL M, an o-phenyl-phenol, $Na^+$ salt, from Nipa Laboratories Ltd., DOWICIDE A, a 1,2-Benzoisothiazolin-3-one, from Dow Chemical Co., and IRGASAN DP 200, a 2,4,4'-trichloro-2-hydroxydiphenylether, from Ciba-Geigy A.G.

Absorbent Materials

The treatment composition of the present invention can be used independently from or in conjunction with an absorbent and/or adsorbent material. For instance, the treatment composition can be formulated to be used in conjunction with a cleaning wipe, sponge (cellulose, synthetic, etc.), paper towel, napkin, cloth, towel, rag, mop head, squeegee, and/or other cleaning device that includes an absorbent and/or adsorbent material.

The cleaning wipe can be made of nonwoven material such as nonwoven, fibrous sheet materials or meltblown, coform, air-laid, spun bond, wet laid, bonded-carded web materials, and/or hydroentangled (also known as spunlaced) materials. The cleaning wipe can also be made of woven materials such as cotton fibers, cotton/nylon blends and/or other textiles. The cleaning wipe can also include wood pulp, a blend of wood pulp, and/or synthetic fibers, e.g., polyester, rayon, nylon, polypropylene, polyethylene, and/or cellulose polymers.

The absorbent material can be constructed as part of a single or multiple layer cleaning pad attached in either the wet or dry state to the end of a mop. The cleaning pads will preferably have an absorbent capacity, when measured under a confining pressure of 0.09 p.s.i. after 20 minutes, of at least about 1 g deionized water per g of the cleaning pad, preferably at least about 10 g deionized water per g of the cleaning pad.

When the cleaning formulation is incorporated in an absorbent material, the treatment composition may include an effective amount of release agent to increase the amount of polymer released from the cleaning wipe onto a surface. The release agent is preferably an ionic species designed to compete with the polymer for sites on the cleaning wipe thereby causing increased polymer release from the cleaning wipe during use of the cleaning wipe. The release agent may include a salt. A variety of different salts can be used such as, but not limited to, monovalent salts, divalent salts, organic salts, and the like. Preferably, the effective ionic strength of the release agent in the treatment composition is at least about $5\times10^{-3}$ mol/l.

The absorbent material may in one embodiment serve as the treating means for distributing the inventive copolymer compositions onto the surfaces of the articles to be treated. In combination with a kit according to another embodiment of the present invention, instructions for treating a polymeric substrate with an absorbent wipe saturated with the inventive copolymer treatment compositions would include the step of evenly distributing the liquid compositions across the article surface to simultaneously effect cleaning of the surface and renewal of the inventive copolymer film on the treated article surface. The same absorbent material, having dispensed its charge of treatment composition, or another absorbent material independent of the first, can then be used to effectively dry the polymeric substrate surface without the need for rinsing with water, by the action of wiping the surface until substantially dry.

In yet another embodiment, the inventive compositions may be applied in a dry form to an absorbent carrier or applied via a liquid carrier that is allowed to dry or evaporate to deposit an essentially dry form of the inventive composition onto and/or within the absorbent material. In these embodiments, the absorbent material would be wetted with water or solvent prior to, or during use, for example in applying to a previously wetted surface, to activate the absorbent material and thereby enable release and transfer of the inventive copolymers from the absorbent material to the surface of the substrate material to be treated. In yet another embodiment, other adjuncts could also be deposited, applied or dried onto the absorbent material in combination with the inventive copolymers to provide an essentially dry or dry-to-touch wipe or material that could be used to apply the inventive copolymers to surfaces, either pre-wetted with water, or when activated with water or other suitable solvent effective in aiding transfer of the inventive compositions to the surface to be treated.

The following examples illustrate treatment and cleaning compositions of the invention. The examples are for illustrative purposes only and are not meant to limit the scope of the invention in any way.

Test Methods

Various formulations of the inventive treatment composition were prepared and tested with respect to (i) water sheeting index and (ii) soap scum repellency, and (iii) appearance.

Water Sheeting

Prior to treatment with the inventive copolymers, the hydrophobic nature of the polymeric substrates of the present invention results in the tendency for water to bead when applied to surfaces of untreated articles constructed from these substrates. The inventive copolymers and formulations are particularly useful because of their ability to treat the polymer substrates to provide a treated article exhibiting prolonged hydrophilization of the surface, resulting in a prolonged sheeting action when exposed to water, which promotes the flow of water and soils from the treated surfaces. The prolonged sheeting action is measured by a method that employs intermittent water contact that exposes the inventive treated articles to fresh aliquots of water to simulate typical exposures of household surfaces, including for example, the walls of a shower stall exposed to water spray during repetitive use. The prolonged sheeting benefit is expressed by the Water Sheeting Index, which is the number of rinse cycles through which treated article continues to exhibit the ability to sheet water.

For test purposes, articles of polyvinyl chloride (PVC), polystyrene and Plexiglas™ (PMMA) may be suitably employed. Test panels of these materials are preferably cut into square (4"×4") panels for ease of handling. The test panels are thoroughly cleaned before use, preferably in an automatic dishwasher to remove all residues followed by wiping the test surface with isopropyl alcohol and allowing to thoroughly dry. The test panel is then positioned in a vertical orientation. Using a pump sprayer, tap water is sprayed onto the surface of the test panel to confirm that water beading occurs to ensure that no residual material or contamination is present, otherwise the test panel is cleaned again. In all cases the pump sprayer is positioned about 12" from the front surface of the test panel. If beading is observed, the panel is then allowed to dry and test compositions are applied to the same surface by spraying twice using a similar pump sprayer. The test panel is left to stand for two minutes. The treated surface is then sprayed with tap water using the pump spray. Two complete sprays of water are counted as one "rinse cycle," and the rinse cycles are repeated and counted until water beading is visually seen to occur on at least about 75% of the area of the treated surface. Control compositions (A-C) containing optional adjuncts, in addition to inventive compositions (1-12) containing the inventive copolymers with or without the optional adjuncts are measured at the same time for comparison.

Replicates of three identical trials for each treated article employing the inventive copolymer composition or control compositions without the inventive copolymers are performed for statistic accuracy. The total number of rinse cycles is counted and the average value of the three trials required before water beading is visually seen to occur represents the Water Sheeting Index of the respective treatment.

Results presented in Table 1 show that the treated articles of the present invention exhibit a Water Sheeting Index greater than 6, and in fact in excess of 30, indicated as "30+". Results also demonstrate the general utility of the inventive compositions for over a wide range of solution pH, including from about pH 2 to about pH 12. Results also demonstrate the compatibility of the inventive polymer systems for use in combination with a cleaning agent, such as for example, a surfactant and other adjuncts so as to function as both a treating and cleaning composition simultaneously in preparing polymeric substrates for surface modification. The inventive compositions have utility in cleaning soiled as well as previously treated surfaces for the purpose of removing surface residues more easily and in restoring the copolymer film for continued protection benefit, particularly a prolonged water sheeting benefit.

TABLE 1

| Examples[1] | Polymer[2] | APG[3] | Glycolic Acid[4] | EDTA[5] | pH | Water Sheeting Index[6] |
|---|---|---|---|---|---|---|
| Control | — | 1.0 | | | 8.6 | 6.0 |
| Control | — | 1.0 | 1.0 | | 2.3 | 4.6 |
| Control | — | 1.0 | | 1.0 | 11.5 | 5.3 |
| 1 | A | 1.0 | | | 7.47 | 30+ |
| 2 | A | 1.0 | 1.0 | | 2.72 | 30+ |
| 3 | A | 1.0 | | 1.0 | 11.34 | 30+ |
| 4 | B | 1.0 | | | 7.7 | 30+ |
| 5 | B | 1.0 | 1.0 | | 2.73 | 30+ |
| 6 | B | 1.0 | | 1.0 | 11.5 | 30+ |

[1]Water represents the balance of all compositions to 100 wt %.
[2]Polymers all at 1 wt %:
A Copolymer of dimethylaminopropyl methacrylate: 2-acrylamido-2-methyl-1-propanesulfonic acid (1:1 ratio).
B Copolymer of dimethylaminopropyl methacrylate: 2-acrylamido-2-methyl-1-propanesulfonic acid (4:1 ratio).
[3]APG 325N, an alkyl polyglycoside surfactant available from Cognis Co.
[4]Used to lower pH.
[5]Used in the form of the tetrapotassium salt of ethylenediaminetetraacetic acid to raise pH.
[6]Average of three trials on polyvinylchloride (PVC).
[7]Greater than 30 cycles for all replicates indicated by (+).

Soap Scum Repellency

Prior to treatment with the inventive copolymers, the hydrophobic nature of the polymeric substrates results in the tendency for soap scum and oils, for example body oils like sebum, to deposit onto the surfaces of untreated articles. Soap scum is hydrophobic in nature, generally known to be in the form of insoluble salts, usually in association with divalent calcium and magnesium cations, of anionic surface active agents including fatty acid soaps and synthetic anionic surfactants present in soap that are formed when compositions containing these materials are combined with tap water, and particularly with "hard water" that has higher levels of these divalent cations present. The inventive copolymers and formulations are particularly useful because of their ability to treat the polymer substrates to provide a treated article exhibiting hydrophilization of the surface, resulting in decreased deposition of soap scum.

Surprisingly, the articles treated according to the methods and compositions of the present invention also exhibit improved soap scum repellency effect even when exposed to repetitive challenges with soap solution, sebum oil and hard water. This effect can be observed visually by exposing treated panels to repetitive exposures of a soap scum solution over a number of cycles, and observing the performance of the inventive treated articles in continuing to exhibit the ability to repel the formation of soap scum, following repeated, intermittent contact with hard water, soap solution and sebum. In the Soap Scum Repellency test, repetitive challenge simulates exposures of household surfaces subject to such intermittent soil contact, including for example, the walls of a shower stall or sink exposed to water spray, soap scum and sebum oil during repetitive use.

For test purposes, articles of polyvinyl chloride, polystyrene and Plexiglas™ may be suitably employed, preferably in the form of opaque or darkly colored panels of these materials because visual evaluation will be preformed. For this purpose, gray PVC panels, and glossy (high shine) black PMMA panels are preferred since this enables the presence of even small amounts of soap scum to be clearly discerned and rated by eye. Test panels of these materials are preferably cut into square (4"×4") panels for ease of handling. The test panels are thoroughly cleaned before use, preferably in an automatic dishwasher to remove all residues followed by wiping the test surface with isopropyl alcohol and allowing to thoroughly dry. The test panel is then positioned in a vertical orientation. Using a common pump sprayer, tap water is sprayed onto the surface of the test panel to confirm that water beading occurs to ensure that no residual material or contamination is present, otherwise the test panel is cleaned again. In all cases the pump sprayer is positioned about 12" from the front surface of the test panel. If beading is observed, the panel is then allowed to dry and test compositions are applied to the same surface by spraying three times (delivering approximately 3.7 milliters of the inventive treatment composition) using a similar pump sprayer. The test panel is left to dry for ten minutes and then rinsed with hard water (5.0 milliters of a 300 ppm by weight solution of a 3:1 weight % mixture of calcium:magnesium chloride in water). Cycling of the panel to simulate exposure to hard water and soap solution is then started. The test panel is sprayed with hard water (3.7 milliters of 300 ppm hardness) and then freshly prepared soap solution (3.7 milliters of 300 ppm of Ivory Soap combined with 150 ppm sebum oil solution at a pH of about 7.8), together which constitute one cycle. The cycles are continued until an untreated panel control (article untreated with the inventive polymer composition) develops a perceivable level of soap scum build-up clearly discemable by eye. Generally, about 5 cycles achieve a noticeable level of soap scum accumulation on the untreated panels. The same number of cycles is applied to all panels, and five (5) replicates of each panel are prepared for statistical purposes.

After cycling, the test panels are allowed to dry (about 10 minutes) and are then compared by visual comparison against an untreated control to determine if improved soap scum repellency was achieved and noticeable by human eye. Generally, test surfaces lacking the inventive treatment collect a highly visible film of soap scum that is highly apparent and unacceptable, providing a "poor" baseline for comparison of improved soap scum repellency performance.

Results presented in Table 2 show that a representative plastic surface employing copolymer treatment compositions of the present invention exhibit improved soap scum repellency compared to a cleaned, but non-polymer treated surface. While not all soap scum residue was prevented from forming on the treated surfaces by use of the inventive polymer treatments, a noticeable reduction in the level of soap scum was noted at both low and high pH formulation ranges, demonstrating the utility of the inventive polymers in cleaning compositions to provide cleaning and improved repellency characteristics to treated polymeric substrates.

TABLE 2

| Example[1] | Polymer[2] | APG[3] | Glycolic Acid | EDTA | pH |
|---|---|---|---|---|---|
| Control | — | — | — | — | — |
| Control | | 2.2 | | 0.4 | 00.6 |
| 7 | A | 2.2 | 1.5 | | 2.6 |
| 8 | A | 2.2 | | 0.4 | 10.6 |
| 9 | B | 2.2 | 1.5 | | 2.6 |
| 10 | B | 2.2 | | 0.4 | 10.6 |
| 11 | C | 2.2 | 1.5 | | 2.6 |
| 12 | C | 2.2 | | 0.4 | 10.6 |

[1]Water represents the balance of all compositions to 100 wt %.
[2]Polymers all at 0.5 wt %.
A Copolymer of dimethylaminopropyl methacrylate: 2-acrylamido-2-methyl-1-propanesulfonic acid (1:1 ratio).
B Copolymer of dimethylaminopropyl methacrylate: 2-acrylamido-2-methyl-1-propanesulfonic acid (4:1 ratio).
C Copolymer of dimethylaminopropyl methacrylate: 2-acrylamido-2-methyl-1-propanesulfonic acid (2:1 ratio).
[3]APG 325N
[4]PVC substrate, all treatments showed less visually noticeable soap scum residue compared to cleaned, but non-polymer treated control and an untreated control tile previously cleaned with distilled water and alcohol, and dried.

The appearance of treated articles was essentially unchanged after application of the treatment compositions compared to the untreated substrates, so that in all cases the presence of a copolymer film even on high gloss materials was invisible to the human eye. Further, no visual effects associated with macroscopic films, such as diffraction or reflective interference effects were noted. The latter are particularly seen for example when an immiscible oil layer forms on the surface of water, exhibiting a thickness on the order of the wavelength of light incident to the surface. Accordingly, without being bound by theory, the absence of any such visual effects under normal white light viewing conditions suggests that the copolymer films formed on the treated polymeric substrates are extremely thin, and of a thickness less than about 400 nanometers, being the lower visible wavelength of light normally perceivable by the human eye.

The foregoing has described the principles, preferred embodiments, and modes of operation of the present invention. However, the invention should not be construed as limited to the particular embodiments discussed. Instead, the above-described embodiments should be regarded as illustrative rather than restrictive, and it should be appreciated that variations may be made in those embodiments by workers skilled in the art without departing from the scope of the present invention as defined by the following claims.

What is claimed is:

1. A treated article comprising: (a) a polymeric substrate; and (b) a hydroscopic film formed on a surface of said polymeric substrate, wherein said hydroscopic film comprises a water-soluble or water-dispersible copolymer consisting of:

(i) a first monomer that is an acrylate and that is capable of forming a cationic charge on protonation;

(ii)at least one of a second monomer that is acidic and that is capable of forming an anionic charge in the compositions;

(iii) optionally, a third monomer that has an uncharged hydrophilic group; and (iv)optionally, a fourth monomer that is hydrophobic.

2. The treated article of claim 1, wherein said second monomer is selected from the group consisting of acrylic acid, methacrylic acid, ethacrylic acid, dimethylacrylic acid, maleic anhydride, succinic anhydride, vinylsulfonate, cyanoacrylic acid, methylenemalonic acid, vinylacetic acid, allylacetic acid, ethylidineacetic acid, propylidineacetic acid, crotonoic acid, fumaric acid, itaconic acid, sorbic acid, angelic acid, cinnamic acid, styrylacrylic acid, citraconic acid, glutaconic acid, aconitic acid, phenylacrylic acid, acryloxypropionic acid, aconitic acid, phenylacrylic acid, acryloxypropionic acid, vinylbenzoic acid, N-vinylsuccinamidic acid, mesaconic acid, methacroylalanine, acryloylhydroxyglycine, sulfoethyl methacrylate, sulfopropyl acrylate, sulfonic acid, styrenesulfonic acid, sulfoethylacrylic acid, 2-methacryl-oyloxymethane-1-sulfonic acid, 3-methacryoyloxypropane-1-sulfonic acid, 3-(vinyloxy)propane-1-sulfonic acid, ethylenesulfonic acid, vinyl sulfuric acid, 4-vinylphenyl sulfuric acid, ethylene phosphonic acid, vinyl phosphoric acid, 2-acrylamido-2-methyl-1-propanesulfonic acid, and mixtures thereof.

3. The treated article of claim 1 wherein said polymeric substrate comprises a material selected from the group consisting of polyethylene terephthalate, polyamide, polyurethane, polyester, polyethylene, polyvinyl chloride, chlorinated polyvinylidene chloride, polyacrylamide, polystyrene, polypropylene, polycarbonate, polyaryletherketone, poly(cyclohexylene dimethylene cyclohexanedicarboxylate), poly (cyclohexylene dimethylene terephthalate), poly(cyclohexylene dimethylene terephthalate) glycol, polyetherimide, polyethersulfone, poly(ethylene terephthalate) glycol, polyketone, poly(oxymethylene), polyformaldehyde), poly (phenylene ether), poly(phenylene sulfide), poly(phenylene sulfone), polystyrene, polysulfone, polytetrafluoroethylene, polyurethane, poly(vinylidene fluoride), polyamide, polyamide thermoplastic elastomer, polybutylene, polybutylene terephthalate, polypropylene terephthalate, polyethylene naphthalate, polyhydroxyalkanoate, polyacrylate, poly(methyl)-methacrylate, polytrimethylene terephthalate, polyvinylchloride, polyvinylidene chloride, copolyester thermoplastic elastomer, olefinic thermoplastic elastomer, styrenic thermoplastic elastomer, urethane thermoplastic elastomer, thermoplastic rubber vulcanisate, rubber, neoprene, vinyl, silicone elastomer, and combinations thereof.

4. The treated article of claim 1 wherein said hydroscopic film formed on said surface of said polymeric substrate has a thickness less than the wavelength of light incident to the surface.

5. The treated article of claim 1 wherein said hydroscopic film formed on said surface of said polymeric substrate is less than 400 nanometers in thickness.

6. The treated article of claim 1 wherein the mole ratio of the first monomer to second monomer ranges from 19:1 to 1:10.

7. The treated article of claim 1 wherein the mole ratio of the first monomer to second monomer ranges from 10:1 to 1:10.

8. The treated article of claim 1 wherein the mole ratio of the first monomer to second monomer ranges from 4:1 to 1:4.

9. The treated article of claim 1 wherein the Water Sheeting Index is greater than 6.

10. The treated article of claim 1 wherein the Water Sheeting Index is greater than 10.

11. The treated article of claim 1 wherein the copolymer includes a third monomer that is selected from the group consisting of vinyl alcohol, vinyl acetate, vinyl methyl ether, vinyl ethyl ether, ethylene oxide, propylene oxide, hydroxymethacrylate, hydroxyethacrylate, hydroxypropyl acrylate, alkylpolyglycoside esters, and polyethylene glycol esters of acrylic acid, polyethylene glycol esters of methacrylic acid, and mixtures thereof.

12. The treated article of claim 11 wherein said copolymer includes a third monomer and the mole ratio of the first monomer to third monomer ranges from 10:1 to 1:10.

13. The treated article of claim 1 wherein the copolymer includes a fourth monomer that is selected from the group consisting of C1-4 alkyl esters of acrylic acid and of methacrylic acid, allyl methacrylate, isobornyl methacrylate, and mixtures thereof.

14. The treated article of claim 13 wherein the mole ratio of the first monomer to fourth monomer ranges from 10:1 to 1:10.

15. The treated article of claim 1 wherein said treated article further exhibits an improved soap scum repellency performance compared to an untreated article.

16. A method for preparing a treated article, comprising the steps of:

(1) providing a polymeric substrate; and (2) applying a liquid treatment composition to said polymeric substrate that comprises:

(a) a water-soluble or water-dispersible copolymer having:

(i) a first monomer that is an acrylate and that is capable of forming a cationic charge on protonation, (ii) at least one of a second monomer that is acidic and that is capable of forming an anionic charge in the compositions;

(iii) optionally, a third monomer that has an uncharged hydrophilic group;

and (iv) optionally, a fourth monomer that is hydrophobic;

(b) a surfactant;

(c) optionally, an organic solvent;

(d) optionally, an adjunct; and (3) removing said liquid treatment composition from said substrate to leave a treated article.

17. The method of claim 16, wherein said step (3) of removing said liquid treatment composition comprises the step of rinsing said substrate with water.

18. The method of claim 16 wherein said liquid treatment composition comprises an aqueous carrier comprising water and optionally an organic solvent.

19. A kit for treating a polymeric substrate to provide a treated article comprising:

(a) a liquid treatment composition comprising:

(1) a water-soluble or water-dispersible copolymer consisting of:

(i) a first monomer that is an acrylate and that is capable of forming a cationic charge on protonation;

(ii) at least one of a second monomer that is acidic and that is capable of forming an anionic charge in the compositions;

(iii) optionally, a third monomer that has an uncharged hydrophilic group; and (iv) optionally, a fourth monomer that is hydrophobic;

(2) a surfactant;

(3) optionally, an organic solvent;

(4) optionally, an adjunct; and;

(b) instructions for treating said polymeric substrate by application of said liquid treatment composition.

20. The treated article of claim 1, wherein said first monomer is selected from the group consisting of: dialkylaminoethylmethacrylate, dialkylaminoethylacrylate, dialkylaminopropylmethacrylate, dialkylaminopropylacrylate, trialkylammoniumethylmethacrylate, trialkylammoniumethylacrylate, trialkylammoniumpropylmethacrylate, trialkylammoniumpropylacrylate, and mixtures and isomers thereof.

* * * * *